United States Patent [19]

Lannom

[11] 4,438,602

[45] Mar. 27, 1984

[54] LENS CARRIER ASSEMBLY FOR AUTOMATIC LENS BLOCKING

[76] Inventor: Charles S. Lannom, Box 270, Grinnell, Iowa 50112

[21] Appl. No.: 277,159

[22] Filed: Jun. 25, 1981

[51] Int. Cl.[3] ..... E05F 11/00

[52] U.S. Cl. ..... 51/277; 51/216 LP

[58] Field of Search ..... 51/277, 216 LP, 217 L; 33/28, 174 A; 269/66, 73, 239, 296, 254 R, 234 CS, 287 MR

[56] References Cited

U.S. PATENT DOCUMENTS

| | | | |
|---|---|---|---|
| 3,451,177 | 6/1969 | Buckminster et al. | 51/277 |
| 3,507,076 | 4/1970 | Rudd et al. | 51/277 |
| 4,138,085 | 2/1969 | Bicskei | 33/174 A |
| 4,227,349 | 10/1980 | Bicskei | 51/277 X |
| 4,229,911 | 10/1980 | Bicskei | 51/277 X |
| 4,288,946 | 9/1981 | Bicskei | 51/277 X |

*Primary Examiner*—E. R. Kazenske
*Assistant Examiner*—Douglas D. Watts
*Attorney, Agent, or Firm*—Merchant, Gould, Smith, Edell, Welter & Schmidt

[57] ABSTRACT

A lens carrier assembly is adapted for mounting on the vertically movable portion (14) of a vertexometer (18) to allow the user to verify, decenter and apply a blocking device to a lens held in the assembly. The assembly includes a pair of spring-biased arms (2) for holding a lens therebetween. A mechanism (1,3,4,5) for rotating the lens held between the arms (2) may also be provided. A base, having three stages (12, 13, 14), includes joints (15) which allow relative lateral movement between the stages (12, 13) for lateral decentration of the lens. The vertically movable portion (14) of the vertexometer (18) provides the mechanism for vertical decentration of the lens. The decentered lens may be marked for blocking or blocked prior to removing it from the assembly.

3 Claims, 7 Drawing Figures

LENS CARRIER ASSEMBLY FOR AUTOMATIC LENS BLOCKING

TECHNICAL FIELD

This invention relates to the manufacture of lenses for spectacles, but more particularly to an apparatus and the procedure for mounting a lens block on a lens so it may be chucked in a machine to effect an edge.

BACKGROUND

In the conventional process, an ophthalmic finished uncut lens is first marked according to its optical center and its axis on a vertexometer or its equivalent. Secondly, the lens is placed on a different device used to decenter the lens a predetermined amount according to prescription requirements. The lens is then marked for subsequent block placement in a third and separate step or the block is placed directly on the lens. The lens would then be chucked in a machine for effecting an edge.

What makes this invention useful is that the second and/or third steps stated above are incorporated into the first step. This process increases speed, accuracy and productivity by eliminating unnecessary operations.

SUMMARY

The invention has as its primary function to verify, decenter and apply a blocking device to a finished uncut lens blank in a one step process, thus increasing speed, accuracy, and productivity by eliminating additional operations to accomplish the same task.

In the present invention a standard, commercially available vertexometer is used. A lens carrier assembly is attached to the vertically movable stage of the vertexometer. A pair of upwardly extending arms are provided on the assembly to hold and position the lens as it is being verified, decentered and blocked or marked for blocking.

Mechanisms for decentering the lens held in the assembly are provided. The decentering mechanism includes a mechanism for laterally decentering the lens. A mechanism for vertically decentering the lens is provided on the standard vertexometer. Such mechanisms allow the lens to be properly positioned in accordance with the requirements of an optical prescription and the frame specifications. Along with the standard vertexometer, an assembly for blocking and/or marking the lens for subsequent blocking apart from the assembly is provided. In this manner the assembly allows the user to verify, decenter and mark or block a lens in a single assembly automatically without movement of the lens from one device to another as is necessary with prior art devices.

Preferably, the assembly also includes a mechanism for rotating the lens into alignment with a pre-selected axis setting on the vertexometer which corresponds to the prescription requirements. This eliminates the manual rotation of the lens in the prior art devices.

Other objects of the invention will be apparent hereinafter from the specification and from the recital of the appended claims when considered in conjunction with the accompanying drawings.

DETAILED DESCRIPTION OF A PREFERRED EMBODIMENT

Figure 3:
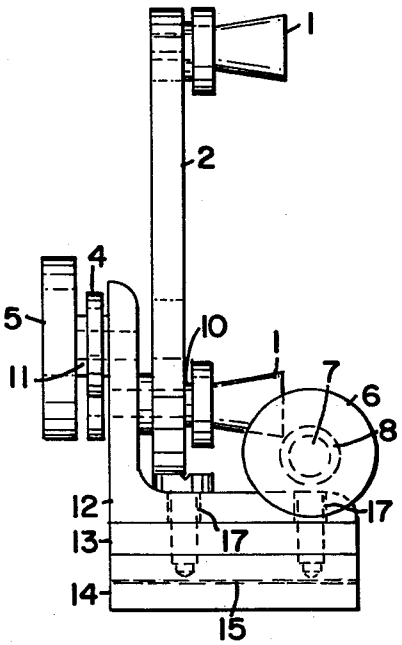
FIG. 3 is a side elevational view of the present invention shown in FIG. 1.
Figure 1:
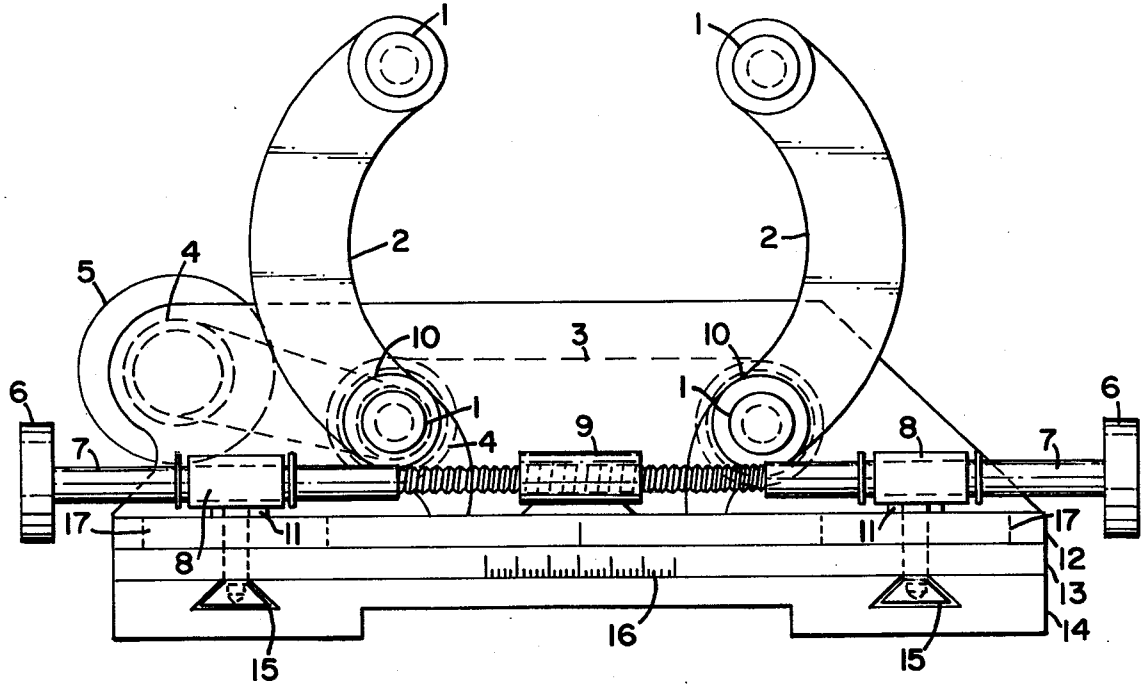
FIG. 1 is a front elevational view of a preferred embodiment of the present invention.
Figures 2, 4:
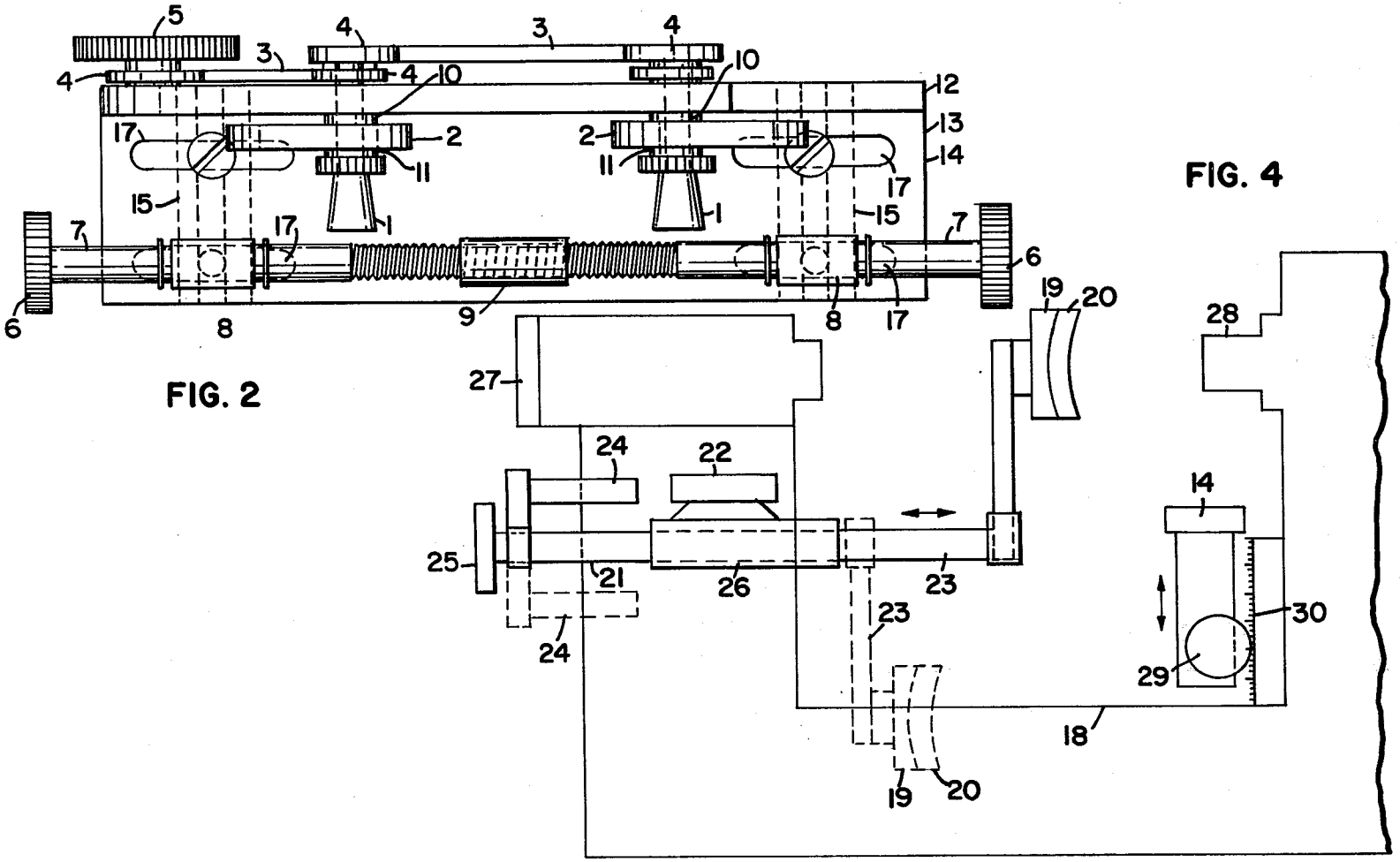
FIG. 2 is a top plan view of the present invention shown in FIG. 1.
FIG. 4 is a schematic diagram of the environment in which the present invention may be used.

Referring now to FIGS. 1–3, the construction of the present invention can be understood. A preferred embodiment of the present invention is shown in the drawings; however, it will be appreciated by those skilled in the art that the invention is not limited by the particular structure of the preferred embodiment, and modifications not shown would be possible in light of the teachings of the invention.

A lens carrier assembly is provided and includes a first or lower stage 14 which is secured to the vertically movable stage of a standard vertexometer or lensometer, as it is also called by those skilled in the art. A second or intermediate stage 13 is positioned on top of the lower stage 14, with a third or upper stage 12 placed on top of the second stage 13. A pair of dovetail joints 15 provided in the lower stage 14 allow sliding movement fore and aft of the second and third stages 13, 12 and the lower stage 14, with the lower stage being fixed in its position on the vertexometer.

A pair of arcuate-shaped arms 2 extending upwardly from a rearward portion of the upper stage 12 are spaced apart from each other a sufficient distance to allow a finished uncut lens to be positioned therebetween. Each arm 2 has an upper free end and a lower end. The lower end of each arm is mounted in the upper stage 12. A rubber roller 1 is provided at each end of each arm with a frictionless washer 11 inserted therebetween. A rotational spring 10 located at the lower end of each arm is secured about a portion of the roller so as to tension or bias the respective arm inwardly towards the other arm 2 in order to temporarily maintain a lens between the arms during the operation of the assembly. Persons skilled in the art will appreciate how such springs are secured to bias the arm inwardly and therefore further details are not believed necessary to enable one to practice this aspect of the invention.

Connected, for simultaneous action thereon, to the lower end of each arm is a mechanism which allows the user to automatically rotate the lower rollers 1 and thereby rotate the lens held therebetween and the upper rollers. In the preferred embodiment a gear drive belt 3 is used to connect the two lower rollers 1. Operably connected to one of the lower rollers and the gear drive belt 3 is a notched drive spur gear 4 which is controlled for movement by a thumbwheel 5. An upwardly extending rear wall portion of the upper stage 12 provides the structural support for the mounting of the rotational mechanism. Rotation of the thumbwheel 5 causes movement of the gear 4 and gear drive belt 3 which in turn rotates the lower rollers 1 on both of the arms 2 causing rotation of the lens positioned therebetween and the upper rollers.

The upper stage 12 further includes two pairs of cutouts 17, a rearward pair and a forward pair. The cutouts are of predetermined length and allow lateral movement of the upper stage 12 relative to the middle and lower stages 13, 14. To effect the lateral movement a mechanism is provided which allows the user to selectively move the stage 12 to the right or to the left when viewed from the front. In the preferred embodiment the mechanism includes a fixed, threaded shaft 7 positioned above the forward pair of cutouts 17. See FIG. 1. The shaft 7 is held in a fixed position above the upper stage 12 by a pair of guide support tubes 8 each of which is fixed in position above a respective forward cutout 17. Each guide support tube 8 is fixed in its position by a screw which also serves to secure the dovetail joint arrangement through the upper and intermediate stages 12, 13. Centrally located on the shaft 7 is a threaded tube assembly 9 which moves laterally. The lateral movement of the tube assembly 9 causes a lateral movement of the upper stage 12 as the tube assembly 9 is permanently attached to the stage 12. At each of the free ends of the threaded shaft 7 a knob 6 is provided for the convenience of the user in effecting rotational movement of the shaft 7 and hence lateral movement of the stage 12 as a result thereof. A vernier scale 16 is marked on a central location at the front of the intermediate stage 13 to assist the user in determining when the prescribed lateral adjustment has been made.

Turning now to FIG. 4, vertical decentration of the lens positioned between the arms 2 is accomplished by movement of the lower stage 14 vertically. A knob 29 is provided for the user to effect upward or downward movement of the stage 14. A scale 30 on the vertexometer allows the user to coordinate the vertical movement with the prescribed vertical decentration of the optical prescription.

One environment in which the invention may be used is shown in FIG. 4. A standard vertexometer 18 is shown schematically. The lower, vertically movable stage 14, knob 29 and scale 30 are illustrated to indicate the location at which the lens carrier assembly would be mounted for use. The vertexometer 18 has a backstop 28 against which the lens rests during the operation of the lens carrier assembly. The lens is positioned against the backstop 28 by fore and aft movement of the stages 12, 13 via the dovetail joints 15.

Along with the vertexometer and the lens carrier assembly a block holding assembly 19 is provided. The assembly 19 includes an adhesively mounted block 20 of the type well known by those skilled in the art. An arm 23 connects the block holding assembly to the mechanism which allows the user to make or block the lens in its position on the lens carrier assembly. The arm 23 is mounted for movement to a rotating plunger shaft 21 which is partially contained within a mount and casing unit 26. When adjustments are being made in the position of the lens in the carrier assembly the blocking assembly 19 is rotated to a lower position as shown by broken lines in FIG. 4. When the proper adjustments have been made in accordance with the prescribed optical prescription for the lens, the blocking assembly 19 is rotated upwardly through rotation of a knob 25 at the free end of the shaft 21. The shaft 21 is then moved forwardly and its alignment with the lens is insured by the insertion of a male plunger guide 24 into an aligned guide tube 22. The adhesively mounted block 20 subsequently contacts the lens surface and the lens is blocked for edging.

An eyepiece 27 is provided to allow the user to optically verify and align the lens as to the optical center in the standard manner.

OPERATION OF THE PREFERRED EMBODIMENT

The lens carrier assembly is attached to the lower stage 14, the vertically movably stage of a vertexometer. The lens carrier assembly has been omitted from FIG. 4 for clarity.

A finished uncut lens is placed between lens positioning arms 2 (see FIG. 1) and rests on and between the rollers 1. The finished uncut lens will rest against the vertexometer backstop 28 (FIG. 4) by sliding the assembly aft along the dovetail joints. This is accomplished by fore and aft movement of the intermediate stage 13.

The axis and power of the cylinder target is set on the vertexometer in the usual manner. The user rotates the finished uncut lens by turning thumbwheel 5 so as to properly focus the lens on the selected vertexometer target.

The proper optical centration is accomplished by adjusting the lateral decentration knob 6 (FIG. 1) and the vertical stage positioning wheel 29 so as to center both the sphere and cylinder target in the eyepiece 27. Lateral lens decentration according to prescription requirements can be made simply by use of knob 6 and measured using the vernier scale 16. Vertical decentration according to prescription requirements is effected by adjusting the wheel or knob 29 which raises or lowers the entire assembly and is measured on vertical scale 30. The lens is now ready for blocking, or marking for subsequent blocking outside of this unit, in the conventional manner.

An adhesive blocking device 20 is placed onto the block-holding assembly 19. This device fits over the central marking pen and does not inhibit its use. The knob 25 is rotated so as to engage the male plunger guide 24 within the guide tube 22. This places the adhesive block 20 in position in front of the lens. The rotating plunger shaft 21 is now pushed until the adhesive block 20 contacts the lens, affixing the block onto the lens surface. The plunger shaft 21 is then retracted leaving the adhesively attached block 20 affixed to the lens in the desired position. The block is now attached to the geometric center of the lens which is decentered from the optical center so as to place the optical center in proper position to meet the prescription requirements. The lens may now be removed from the lens carrier assembly and chucked directly into known machines for effecting an edge.

What is claimed is:

1. A carrier assembly for positioning a finished uncut lens for blocking, said assembly being adapted for securement to the vertically movable portion of a vertexometer and comprising:

(a) a base having a top portion, a bottom portion and means for removably attaching said base to the vertically movable portion of a vertexometer, said base portions being constructed and arranged for movement fore and aft with respect to the vertexometer;

(b) means on said base for holding a lens in a position above said base top portion, said lens holding means including a pair of spaced-apart, arcuate-shaped arms, each of said arms extending upwardly from said base top portion and being biased towards the other arm, and means for allowing rotative movement of a lens held between said arms, said means for allowing rotative movement of the lens including a plurality of rollers mounted on said arms, said plurality of rollers being constructed and arranged to rotate simultaneously with a lens held therebetween; and (c) means on said base for decentering the lens a predetermined value in accordance with an optical prescription, said means including means for moving said base top portion laterally with respect to said base bottom portion, thereby causing a simultaneous lateral decentering of the lens.

2. A carrier assembly for positioning a finished uncut lens for blocking, said assembly being adapted for securement to the vertically movable portion of a vertexometer and comprising:

(a) a base having a top portion, a bottom portion and means for removably attaching said base to the vertically movable portion of a vertexometer, said base portions being constructed and arranged for simultaneous movement fore and aft generally along a rectilinear path with respect to the vertically movable portion of the vertexometer;

(b) means on said base top portion for holding a lens in a position above said base top portion, said lens holding means including a pair of spaced-apart, arcuate-shaped arms, each of said arms extending upwardly from said base top portion and being biased towards the other arm, and means for allowing rotative movement of a lens held between said arms, said means for allowing rotative movement of the lens including a plurality of rollers mounted on said arms, said plurality of rollers being constructed and arranged to rotate simultaneously with a lens held therebetween;

(c) means on said base for actuating the rotation of a lens held between said arms, said actuating means being operatively connected to at least one of said rollers in a manner which actuates rotation of said one roller and thus rotation of the lens and said other roller; and (d) means on said base for decentering the lens a predetermined value in accordance with an optical prescription, said means including means for laterally moving said base top portion with respect to said base bottom portion, thereby simultaneously causing a lateral decentering of the lens.

3. A lens carrier assembly for positioning a finished uncut lens for blocking, said assembly being adapted for securement on the vertically movable portion of a vertexometer and comprising:

(a) a base constructed and arranged for attachment to the vertically movable portion of a vertexometer, said base having an upper stage, a second stage positioned intermediate and generally in alignment with said upper stage and with the vertically movable portion of the vertexometer, first means for simultaneously moving said second stage and said upper stage fore and aft with respect to the vertically movable portion of the vertexometer, and second means for moving said upper stage laterally with respect to said second stage and the vertically movable stage of the vertexometer;

(b) means, extending upwardly from said upper stage, for removably holding a lens, said means including a pair of spring-biased arms having means for allowing rotative movement of the lens, including a plurality of rollers mounted on said arms, a user-operated mechanism mounted on said base for inducing rotative movement, and means connecting at least one of said rollers to said mechanism for transferring rotative movement of said mechanism to the lens; and (c) means for decentering the lens in accordance with an optical prescription, said decentering means including means for actuating said second moving means whereby the lens is laterally decentered simultaneously with the lateral movement of said upper stage.

* * * * *